US006050426A

United States Patent [19]

Leurdijk

[11] Patent Number: 6,050,426

[45] Date of Patent: Apr. 18, 2000

[54] STORAGE TRACK SYSTEM

[76] Inventor: Jan B. Leurdijk, 28 Grandview Crescent, Bradford, Canada, L3Z 2A5

[21] Appl. No.: 08/856,240

[22] Filed: May 14, 1997

[51] Int. Cl.[7] ..... A47F 5/00

[52] U.S. Cl. ..... 211/94.01; 211/57.1; 248/222.51

[58] Field of Search ..... 211/94.01, 87.01, 211/57.1, 59.1; 248/225.11, 222.51, 222.14

[56] References Cited

U.S. PATENT DOCUMENTS

| | | | |
|---|---|---|---|
| 1,572,295 | 2/1926 | Kofsky . | |
| 3,891,172 | 6/1975 | Einhorn . | |
| 4,401,222 | 8/1983 | Kulikowski et al. | 211/94.01 |
| 4,450,970 | 5/1984 | Shepherd | 248/222.51 X |
| 4,607,753 | 8/1986 | Radek . | |
| 4,747,025 | 5/1988 | Barton | 211/94.01 X |
| 4,869,378 | 9/1989 | Miller | 211/94.01 |
| 4,944,416 | 7/1990 | Petersen et al. . | |
| 5,048,698 | 9/1991 | Konrad | 211/94.01 X |
| 5,138,803 | 8/1992 | Grossen . | |
| 5,228,579 | 7/1993 | Kaufman | 211/94.01 |
| 5,337,987 | 8/1994 | Sawatsky . | |
| 5,379,976 | 1/1995 | DeGirolamo . | |
| 5,676,258 | 10/1997 | Leyden et al. | 211/59.1 X |
| 5,740,927 | 4/1998 | Yemini | 211/94.01 X |

*Primary Examiner*—Robert W. Gibson, Jr.
*Attorney, Agent, or Firm*—Piasetzki & Nenniger

[57] ABSTRACT

A storage system for articles. The storage system includes a track for mounting on the wall. The track is formed with a mounting portion which is sized and shaped to permit a fastener to pass through the track and into a wall. A L-shaped groove is formed having a lower seating face and upper retaining slot. Below the groove is a mid section which may include a material saving recess. A lower alignment means is also provided. A hanger bracket is provided with an upper L-shaped portion sized and shaped to be inserted into said groove and shaped to fit into said upper retaining slot while resting on said seating face to retain said bracket on said track. In one embodiment an outwardly extending hook element is provided, and a pair of fasteners is used to secure the bracket to the track.

21 Claims, 8 Drawing Sheets

STORAGE TRACK SYSTEM

FIELD OF THE INVENTION

This invention relates generally to the field of storage devices of the type that may be used to provide a place to store articles, and are sometimes generally referred to as organizers. More particularly this invention relates to those devices which are suitable for storing diverse articles such as may be found in a residence, in the garage, basement, attic, or cellar, and in a workshop, office, retail store, factory or the like.

BACKGROUND OF THE INVENTION

In modern life there are many articles which are typically owned and used by households. These articles vary from cleaning equipment such as mops, brooms, buckets, cleaning fluids and powders, through gardening equipment such as shovels, rakes, hand trowels and the like to even tools, and other miscellaneous articles. These articles are typically used infrequently, such as once a week or even less frequently if they are seasonal in nature. While not in use, these articles need to be stored.

In the past, many different approaches have been taken to provide an efficient and convenient storage system. Some of these devices are intended to be installed in closets, and are referred to as closet organizers. They usually comprise a series of wire racks and hooks which are designed to fit inside a closet or the like. However, often, especially in older homes, there may not be any closet space available to put such organizers in. This is especially true for basements and garages, which are used to store a wide range of goods but may not be fitted with closets.

Therefore, there is a need for a storage system of the sort that can be used on a wall and which provides an opportunity to store various types of articles in an organized and efficient manner. In the past there have been proposed, primarily for retail applications a hanging storage device which is referred to as a slot wall. In the slot wall, a panel is typically provided which can be mounted onto a wall. The panel is grooved or milled to form a plurality of slots, and then hanger brackets are mounted in the slots. Merchandise can then be placed on the hanger brackets and favourably displayed. An example of this type of device is found in U.S. Pat. No. 4,944,416 to Petersen et al.

A problem with the invention of Peterson et al is that it is made from a high density polystyrene foam which is coated with a surface laminate after being milled or routed. Having to form the panel, mill the slots and laminate the outer surface involves three separate manufacturing steps which increases the cost of the finished product. Further, milling or routing the slots after the panel is formed causes the slots to have a symmetry about a horizontal axis. Thus if the slots are formed to have a thin top lip it will be necessary to have a thin lower lip which is fragile and prone to breakage. Lastly the use of a panel may be appropriate in a retail setting but for residences, this is too large and unwieldy.

Other patents which include organizers of the type with grooves or slots are:

| | | |
|---|---|---|
| U.S. Pat. No. 5,379,976 | DeGirolamo | January 10, 1995 |
| U.S. Pat. No. 5,337,987 | Sawatsky | August 16, 1994 |
| U.S. Pat. No. 5,138,803 | Grossen | August 18, 1992 |
| U.S. Pat. No. 4,607,753 | Radek | August 26, 1986 |

SUMMARY OF THE INVENTION

What is desired is a form of an organizer that is not unwieldy is easy to install and yet provides a home owner with an ability to store a diverse assortment of articles. Most preferably the device would be formed in a single step and be relatively inexpensive. Further the device should be sized such that it is easy to transport and to install by the average unskilled home owner.

Thus it is an object of the present invention to provide a track, formed with a single slot, which can be wall mounted and which includes a groove or a slot sized and shaped to carry a hanging bracket or the like. Most preferable the track will be extruded from an expanded foam and will hold nails screws and paint. In this manner the track will be readily mountable to a wall to facilitate providing storage.

Therefore, according to the present invention there is provided, a storage system for articles, the storage system comprising: a track member for mounting on a wall, the track member including:

a mounting portion sized and shaped to permit a fastener to pass there through and into a wall;

a L-shaped groove having a lower seating face and an upper retaining slot, a mid portion; and a lower alignment means; and a hanger bracket including, an upper L-shaped portion sized and shaped to fit into said L-shaped groove with a portion inside said upper retaining slot and a portion resting on said retaining seat; and a hanger element for supporting an article to be hung, wherein said hanger bracket may be tilted and inserted into said track and supported thereby to carry articles. The hanger bracket can be secured to the track by means of screws, preferably two, that are partially inserted in the hanger bracket, and threaded into the track.

BRIEF DESCRIPTION OF THE DRAWINGS

Reference will now be made, by way of example only, to drawings which depict preferred embodiments of the invention and in which.

DETAILED DESCRIPTION OF THE PREFERRED EMBODIMENTS

Figure 1:
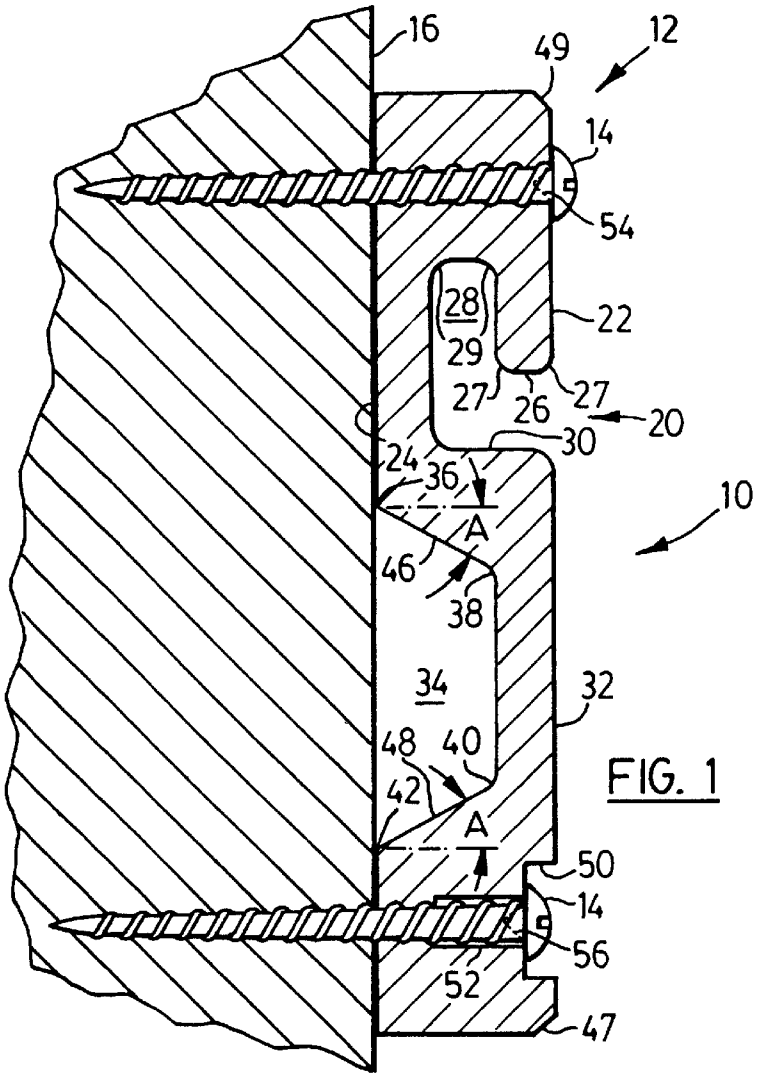
FIG. 1 is a cross-sectional view of a track according to the present invention.

The present invention relates to a storage system for storing and organizing articles, comprising a track member 10 for mounting on a wall which is indicated generally as 10 in FIG. 1. The track member 10 includes an upper portion 12 which is sized and shaped to permit a fastener 14 to pass there through and into a wall 16 to fasten the track 10 to the wall 16.

Below the upper portion 12 is formed an L-shaped groove indicated generally as 20. The L-shaped groove is formed between a front wall 22 and a back wall 24 of the track 10. A downwardly extending tongue 26 forms an upper retaining slot 28 in the groove 20. A lower seating face 30 is also formed. The purpose of the lower seating face 30 is explained in more detail below. It will be noted that the tongue 26 and the upper retaining slot 28 are formed with rounded portions 27 and 29, for strength.

A relatively planar front section 32 is formed below the groove 20. A material saving recess 34 is preferably formed in the back 24 of the track 10. Most preferably, the material saving recess 34 includes gently rounded corners 36, 38, 40 and 42, to avoid creating unnecessary stress raisers. Additionally, the walls 46 and 48 are sloping for increased strength. Further the top and bottom front edges are chamfered as shown at 47 and 49 for aesthetics and functional reasons.

The lower portion of the track 10 is formed with an alignment groove 50 having a plurality of alignment openings 52. Additionally, it is most preferred to form horizontal alignment notches 54 and 56 on the front face of the track 10. It will be noted that the alignment openings 52 do not fully extend through the track 10.

The most preferred method of manufacturing the track 10 according to the present invention is to extrude it from a foamed plastic material. Although several plastic materials may be suitable, the most preferred material is cellular ridged vinyl, which is a form of structural foam or structural ridged foam such as PVC foam. The track 10 is more preferably formed from material having a density of 0.55 to 0.6 specific gravity. The material preferably has a heat distortion temperature of between 60° and 70° C., making it suitable for a typical household temperature range of −40° to 40° C. As will be appreciated by those skilled in the art, for exterior applications, where protection from UV radiation in sunlight is desired, pigmentation and UV blockers can be added as required.

The preferred composition includes vinyl resins, acrylic resin modifiers to improve the products' impact and cell structure, Organo Tin stabilizers to improve processing and lightness, lubricant for improved processing, titanium dioxide to improve colouration and lightness, mineral fillers for reinforcement, and blowing agents such as air, water, nitrogen or carbon dioxide for the foaming.

When a product is made according to these specifications, it is essentially a wood substitute. It can be easily cut with a conventional wood handsaw, drilled with conventional wood drills and yet is relatively durable. The exterior surface is formed with a continuous smooth skin during the extrusion from the dye, and, the material surface holds paint and the like. In this manner, it can be decorated to any suitable colour by the homeowner with a coat of paint. In addition, rather than a complete panel on a slot wall configuration, the track of the present invention is easy to manipulate and is readily purchased by homeowners who wish to do a small home improvement project. The track 10 can be cut to any appropriate length, mounted in accordance with the discussion that follows, and, form the basis for an article storage system. The preferred dimensions for the track 10 are as follows. The overall height is preferred to be between 3" and 10", most preferably about 4" (100 mm). The upper portion is about 18 mm in height, while the groove 28 is about 20 mm from seat 30 to the top of upper retaining slot 28. The groove 28 can be about 6 mm wide. The planar face 32 can be about 45 mm, and the alignment groove is about 10 mm. The total thickness of the track 10 is most preferred to be 18 mm, but can be varied to suit. For example, for heavier applications, a thicker track might be desired. Most preferably the walls 46 and 48 are formed at an angle A, as shown, of between 20° and 45°, most preferably 30°.

The most preferred method of forming the track is to extrude the track through a die having the profile of the track as shown in FIG. 1. In this manner the lower seating face 30 can be made planar. This overcomes a significant problem in the prior art designs which included a symmetrical or T-shaped slot formed by milling routing or the like. When formed from plastics, which may have less shear strength than steel for example, the formation of a downwardly extending groove significantly weakens the strength of the track. However because the present invention contemplates a planar seating face, this problem is largely overcome, making the plastic track strong enough for usual loads.

In addition to being able to engineer the profile for strength, the extruding is preferred because of the smooth external finish than can be achieved. In essence the extrusion process forms an external skin over the track which is appealing to consumers and requires no additional manufacturing steps to finish the product off, prior to packaging. Most preferably the skin is formed in a texture and smoothness that facilitates holding paint and the like.

Figure 2:
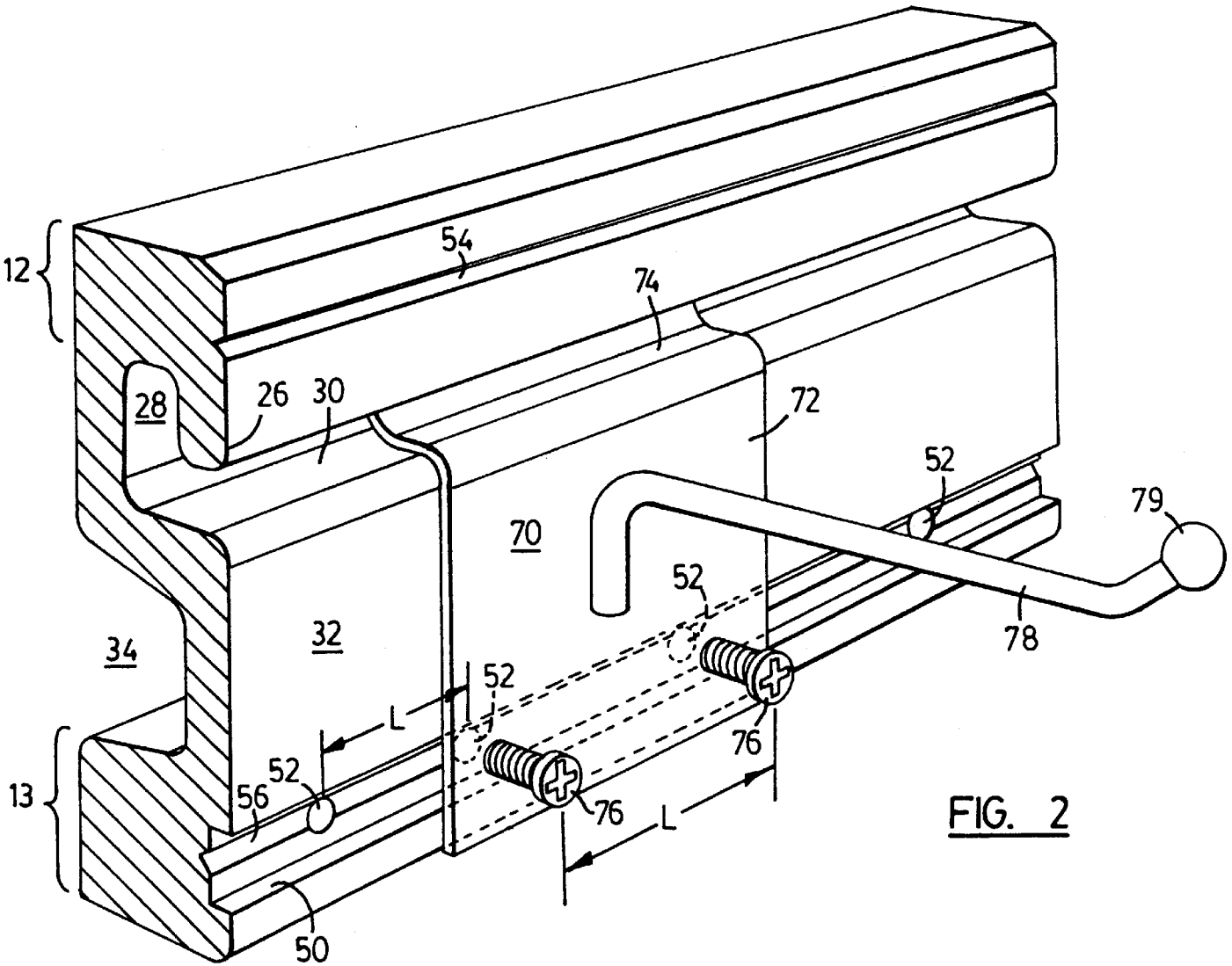
FIG. 2 is an isometric view of the track of FIG. 1, with a hanger bracket.

Turning to FIG. 2, an isometric view of the track of the present invention is shown. As can be seen, the upper and lower alignment notches 54 and 56 are centred on the portion 12 of the track 10 and a lower portion 13 which are intended to accept and guide fasteners to fasten the track 10 to a wall 16. Thus, the upper alignment notch 54 provides an easy starting point for drilling a hole through the track 10 and into the wall 16 for a fastener, or even for driving a nail therethrough. The lower alignment notch 56 in the groove 50 includes the alignment openings 52 as described above. Most preferably, these openings or apertures 52 are set at a distance 'L' apart, most preferably at 32 millimeter centres, in order to provide an equal number of apertures per foot. FIG. 2 shows a number of alignment openings 52. A pair of mounting fasteners 76 fasten a hanger bracket 70 to the track 10 through alignment openings 52. Thus, fasteners 76 are also set with their centres a distance 'L' apart, to match with the openings 52. This distancing allows the track to be readily mounted between 16" stud centres, to retain a symmetrical positioning of the alignment openings 52 there along.

Figure 3:
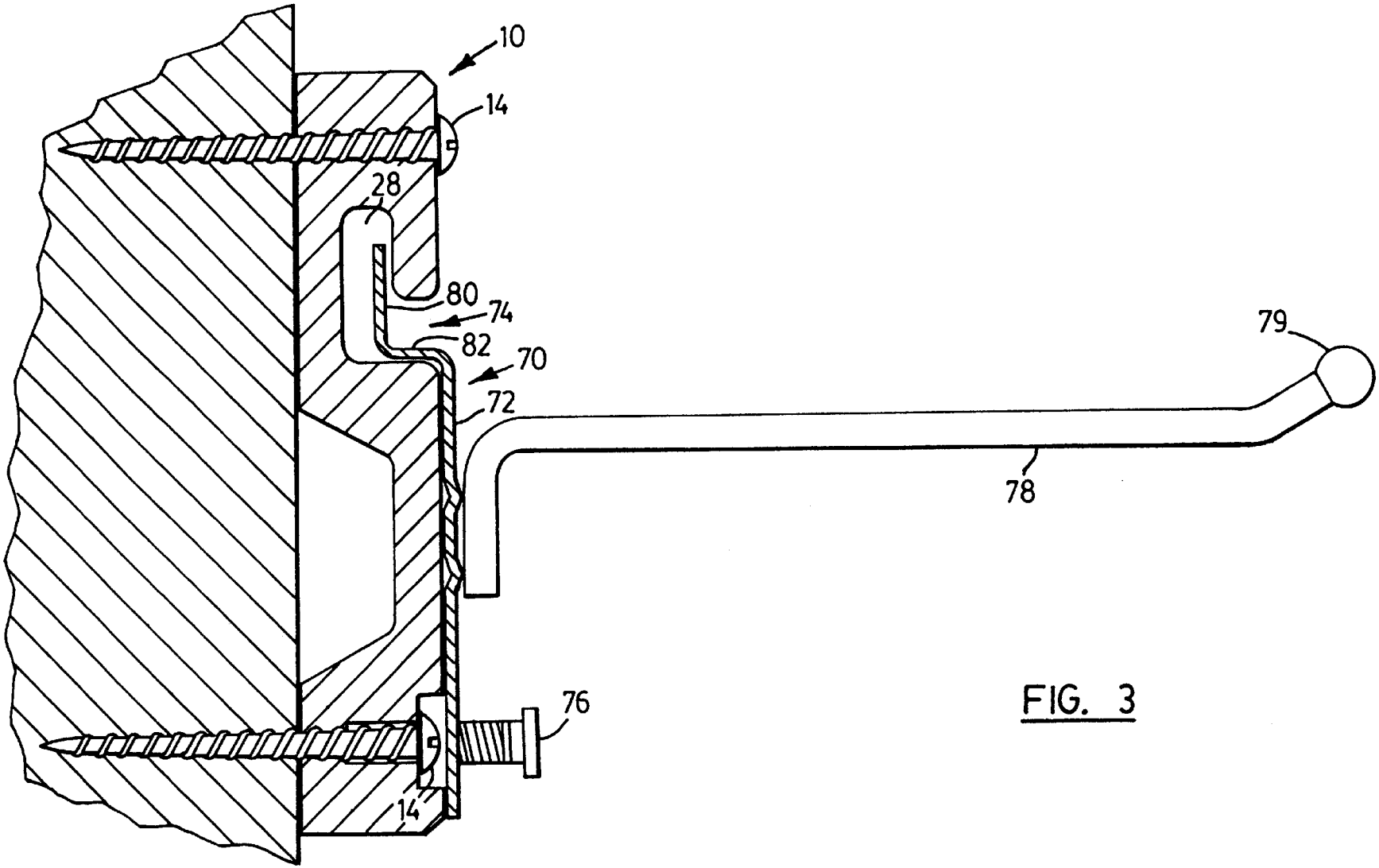
FIG. 3 is a cross-sectional view of the track of FIGS. 1 and 2 including a hanging bracket.

Turning to FIG. 3, there is shown a cross-sectional view of the present invention including the track 10 and hanger bracket 70. The hanger bracket 70 includes a body portion 72 having an L-shaped upper portion 74. The mounting fastener 76 is shown, together with a hook element 78. Most preferably, the hook element 78 is welded to the bracket 70. A safety ball 79 is provided at the end of hook element 78.

It can now be appreciated how the bracket element is secured to the track 10. First, the bracket is tilted in order to allow the upper part 80 of the L-shaped upper section 74 to be inserted into the upper retaining slot 28. Then, the bracket is rotated toward the track, causing the lower portion 82 of the L-shaped upper portion 74 to sit or rest on the lower seating face 30. The bracket is sized and shaped to be held on the seating face 30 when the back of the plate 70 is adjacent to the front of the track 10. Then, the fastener 76 is driven into the alignment opening 52 by screwing or the like. In this manner, the bracket 70 is securely retained in place on the track 10. Although a bending moment is provided through the moment arm of the hanger element, shear forces are carried by the lower seating face 30 and distributed along the track. In this manner, a safe and secure mounting of the hanger bracket 70 onto the track element 10 is achieved.

Figure 4:
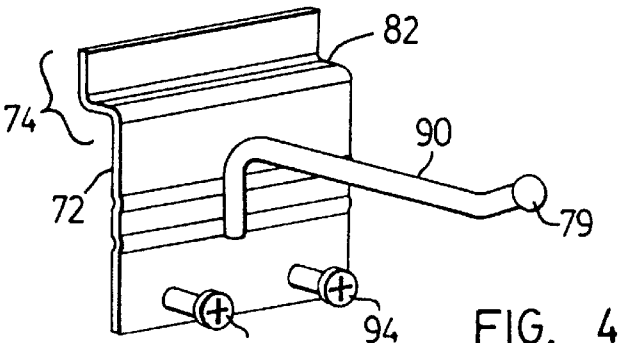
FIG. 4 is the hanger bracket of FIG. 3 in isometric view.

FIG. 4 shows a first embodiment of a bracket element 70 including a single hanging hook 90 and a pair of fasteners 92 and 94. Most preferably the bracket element is made from metal plate, which is stamped or otherwise bent into shape. Either 14 or 12 gauge metal is appropriate and has achieved good results. Also, the metal is preferably coated with a metal sealing epoxy paint for a decorative and desirable finish. Most preferably the plate is about 75 mm in total height. The L-shaped upper portion 74 is preferably about 15 mm high, with a flat section 82 of about 7 mm in length. The holes are preferably on 32 mm centres to align with the track alignment aperture. A ball 79 is formed at the end of the hook for safety reasons. Although various widths of plate can be used, satisfactory results have been obtained with a light bracket of 62 mm width and a heavy bracket of 94 mm in width. The heavy bracket supports heavier articles.

Figure 5:
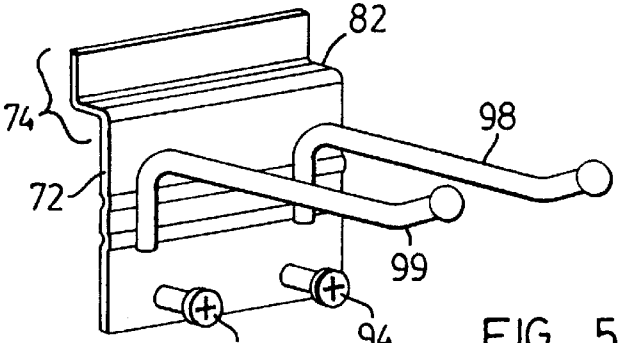
FIG. 5 is an alternate hanging bracket according to the present invention.

FIG. 5 shows a second embodiment of a hanger element including a pair of outwardly extending hooks 98 and 99. Otherwise, this embodiment is identical to the FIG. 4 embodiment.

Figure 6:
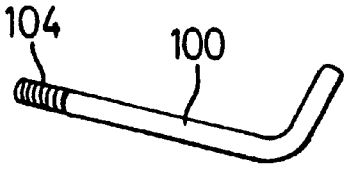
FIG. 6 is a hook.
Figure 7:
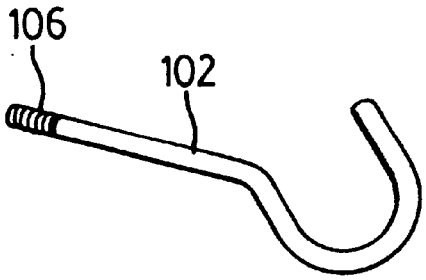
FIG. 7 is a second embodiment of a hook.
Figure 16:
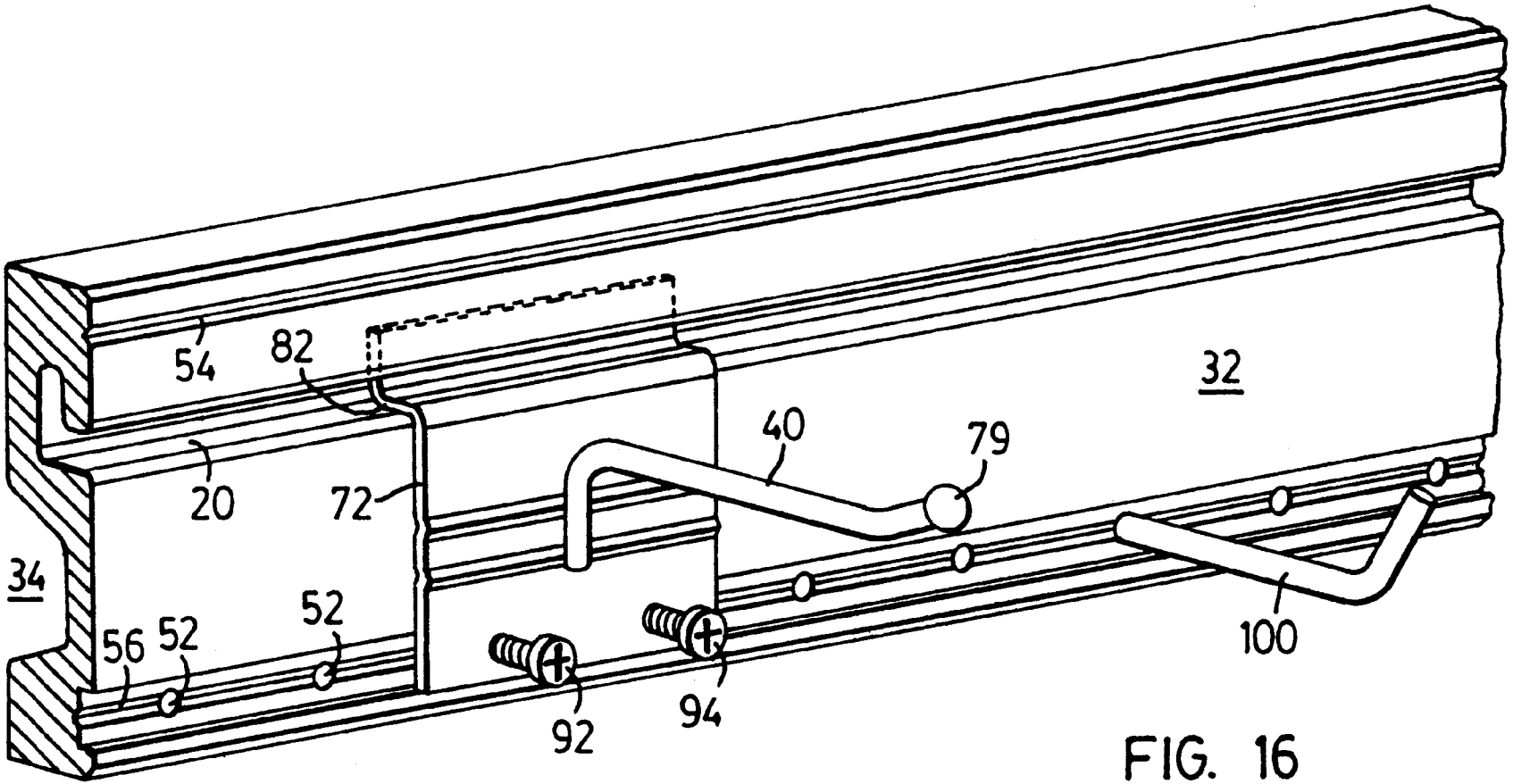
FIG. 16 is an isometric view of the present invention showing a hanger bracket and the hooks attached thereto.

FIG. 6 and FIG. 7 disclose individual hook elements 100 and 102 which have screw portions 104, 106 sized and shaped to be inserted into the alignment apertures 52 of the track 10 (see FIG. 16). In this way, they can be simply driven and screwed into the track to hold up various light weight articles.

Figure 8:
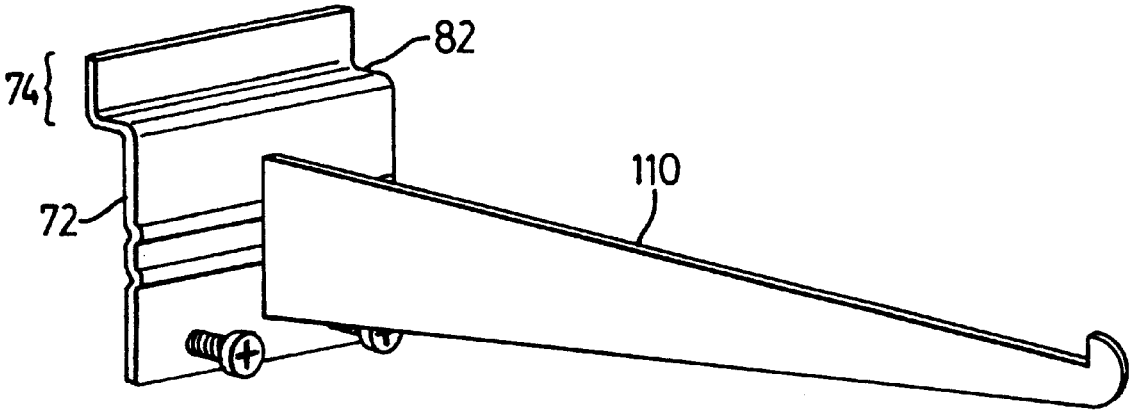
FIG. 8 is a shelf bracket according to the present invention.

FIG. 8 discloses a shelf bracket 110, which can be used in conjunction with other elements as described herein. The shelf bracket 110 is welded to an identical body portion 72 as previously desired.

Figure 9:
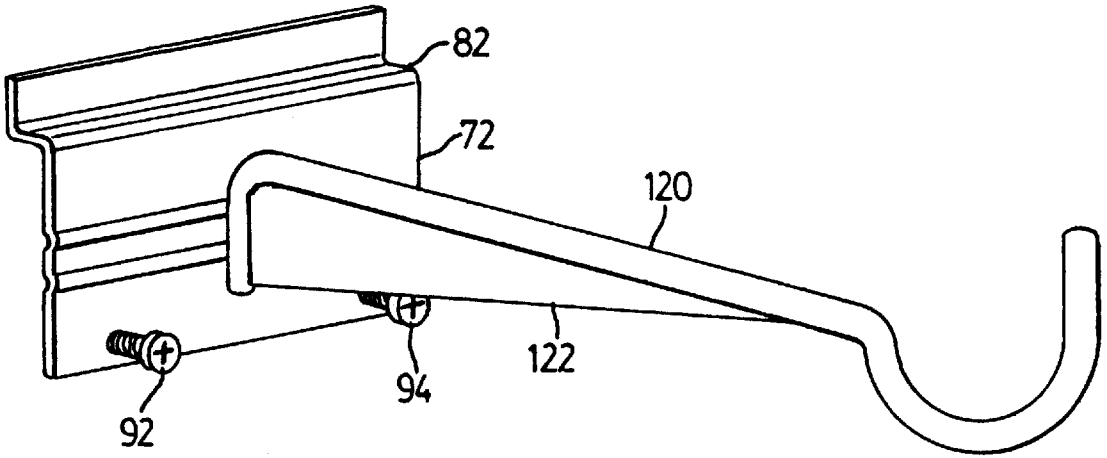
FIG. 9 is a bike bracket.

FIG. 9 shows a specially adapted hook element 120, with a reinforcing web 122 which can be used to support a bicycle for winter storage or the like. Again, hook element 120 is mounted on a like body portion 72.

Figure 10:
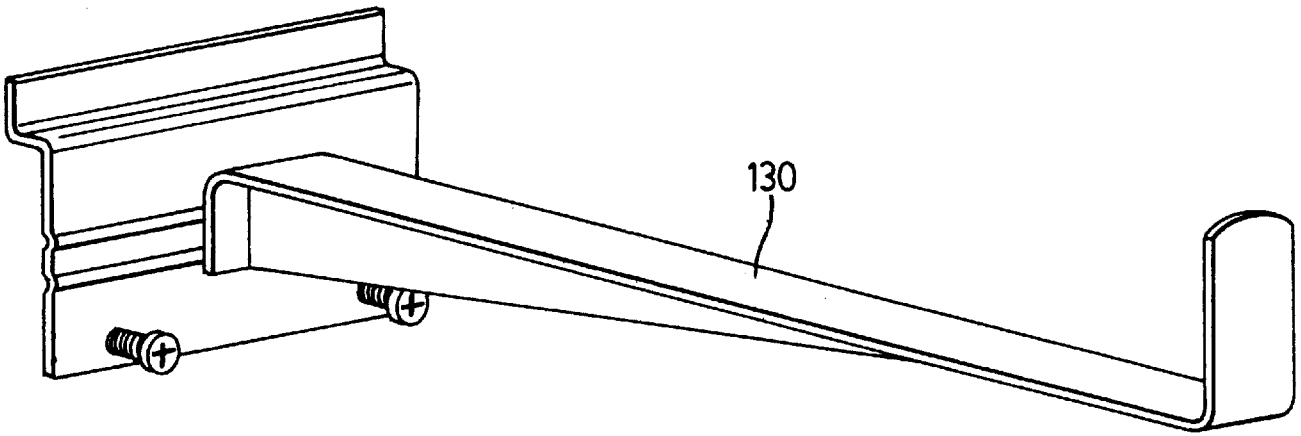
FIG. 10 is a heavy duty utility bracket.

FIG. 10 is a further hook element 130 which is specifically designed to hold flat bottomed articles, such as recycling boxes, lumber, moldings, trim, or the like.

Figure 11:
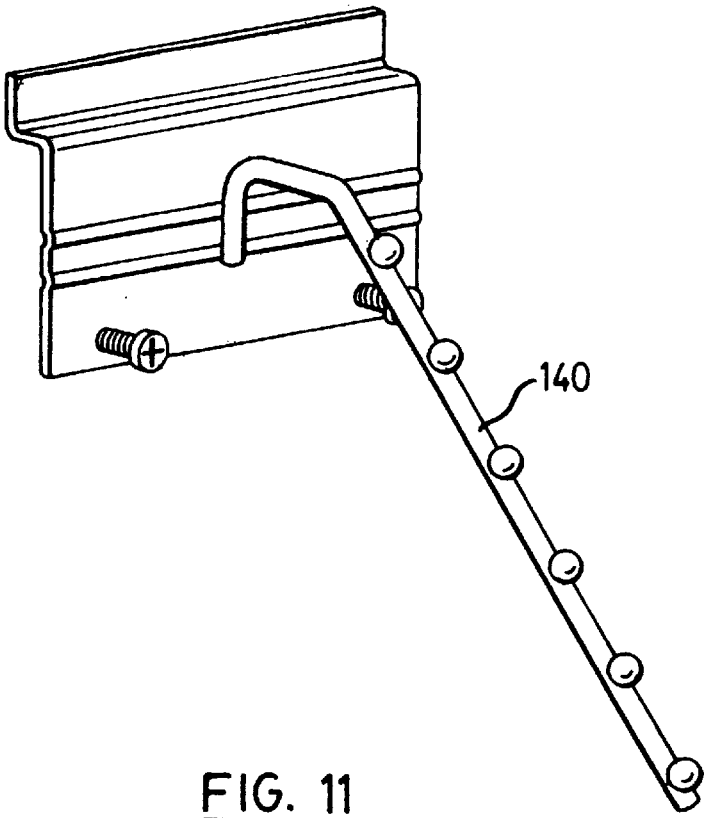
FIG. 11 is a garment bracket.

FIG. 11 is a waterfall bracket 140 which is intended to hold a plurality of clothes hangers or the like.

Figure 12:
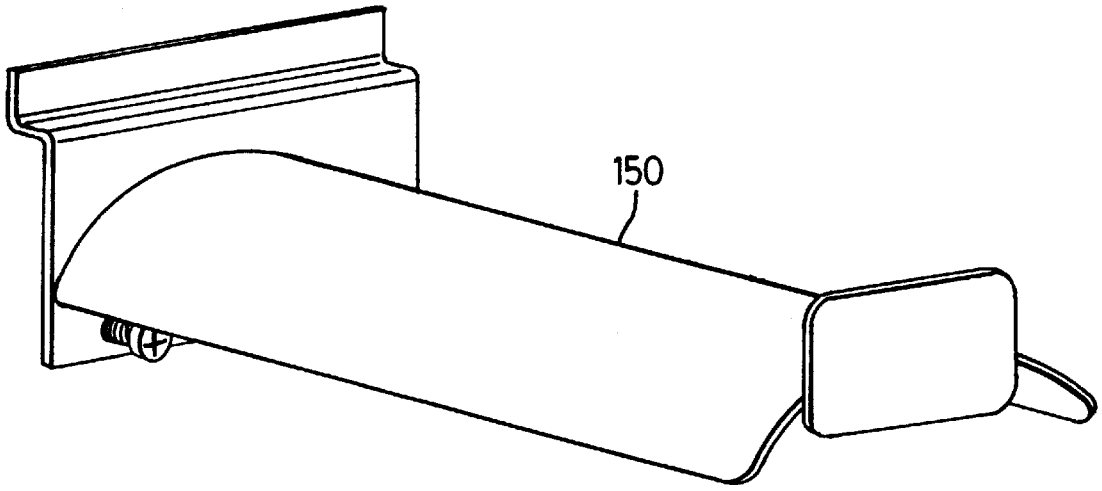
FIG. 12 is a hose bracket.

FIG. 12 is a hose reel bracket 150 which is intended to hold a hose, rope, extension cord, or the like.

Figure 13:
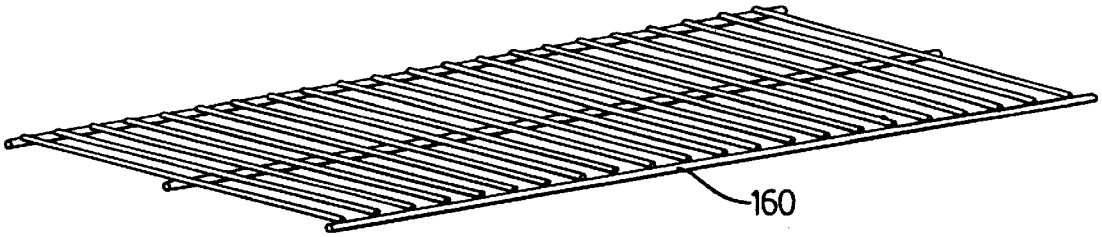
FIG. 13 is a wire shelf.

FIG. 13 is a form of wire shelf 160, which is sized and shaped to be carried by the shelf bracket 110 of FIG. 8.

Figure 14:
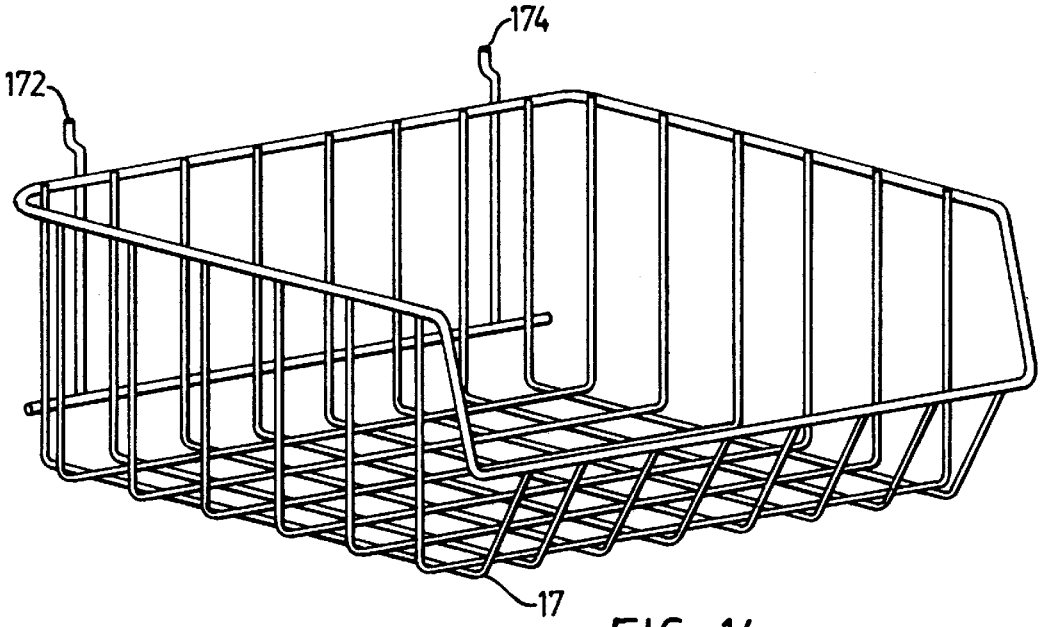
FIG. 14 is a basket.

FIG. 14 is a hanging basket 170, with a pair of L-shaped upwardly projecting members 172, 174 for insertion into the retaining groove 20 of the track 10.

Figure 15:
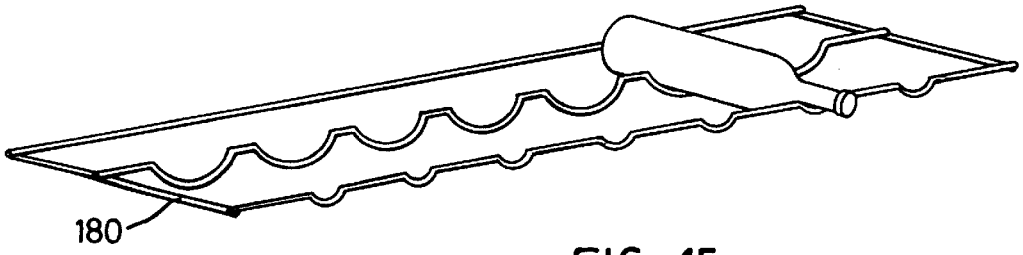
FIG. 15 is a wine rack.

FIG. 15 is a wine rack 180 which is sized and shaped to be carried by the shelf bracket 110 discussed above.

FIG. 16 is an isometric view, indicating how a hanger bracket can be mounted to the track of the present invention.

It will be appreciated by those skilled in the art that various modifications and alterations can be made to this design without departing from the broad spirit of the invention which is defined in the appended claims. For example, while the preferred material is indicated, other material compositions might achieve the same combination of strength, likeness, durability, and ease of use. Further, while a number of different bracket examples are provided, other types of brackets may also be suitable provided they do not put undue stress on the track.

I claim:

1. A storage system for articles, the storage system comprising:

a track member for mounting on a wall, the track member including:

a mounting portion sized and shaped to permit a fastener to pass there through and into a wall;

an L-shaped groove having a lower seating face and an upper retaining slot;

a mid portion; and a lower alignment means comprising a groove, and a plurality of apertures formed in the groove at predetermined locations to facilitate the securing of one or more of said hanger brackets at spaced locations on said track member; and at least one hanger bracket, said hanger bracket including, an upper L-shaped portion sized and shaped to fit into said L-shaped groove with a portion inside said upper retaining slot and a portion resting on said lower seating face; and a hanger element for supporting an article to be hung, wherein said hanger bracket may be tilted and inserted into said track member and supported thereby to carry articles.

2. The invention of claim 1 wherein said track member is formed from cellular ridged vinyl.

3. The invention of claim 2 wherein said track member is formed from a foamed vinyl material having a density of between 0.55 and 0.6 specific gravity.

4. The invention of claim 3 wherein said track member is extruded in a form having a smooth outer skin which is capable of holding paint.

5. The invention of claim 1 wherein said mounting portion further includes an alignment notch for aligning fasteners generally through a centre of said mounting section, said fasteners being adapted to attach said track member to said wall.

6. The invention of claim 1 wherein said lower alignment means comprises a plurality of performed alignment openings, sized and shaped to receive a screw fastener.

7. The invention of claim 5 wherein said lower alignment means further comprises a lower alignment notch for centering fasteners in said lower alignment means, said fasteners being adapted to attach said track member to said wall.

8. The invention of claim 7 further including a lower alignment groove in which said lower alignment notch is formed.

9. The invention of claim 1 wherein said L-shaped groove is formed on a front face and said track member includes a material saving recess formed on a rear face thereof.

10. The invention of claim 9 wherein said material saving recess has sloped side walls capable of improving stress distribution.

11. The invention of claim 6 wherein said performed alignment openings do not extend fully through said track member.

12. The invention of claim 1 wherein said hanger bracket further includes a generally planar main body having a pair of fastener mounting apertures formed therein, each of said fastener apertures being sized and shaped to align with said alignment means; and an outwardly extending hook element mounted on said planar main body and a pair of fasteners, sized and shaped to be inserted into said fastener apertures for fastening said hanger bracket to said track member.

13. The invention of claim 12 wherein said hanger bracket includes two outwardly extending hook elements which are sized and shaped to form a pair of outwardly extending arms.

14. The invention of claim 12 wherein said outwardly extending hook element is sized and shaped to form a shelf bracket.

15. The invention of claim 12 wherein Said outwardly extending hook element is sized and shaped to form a bicycle hook.

16. The invention of claim 12 wherein said outwardly extending hook element is sized and shaped to carry flat objects thereupon.

17. The invention of claim 12 further including a basket element having upper extending arms having L-shaped tops which are sized and shaped to be carried in said groove.

18. The invention of claim 12 wherein said outwardly extending hook element is sized and shaped to carry a hose thereupon.

19. The invention of claim 12 wherein said outwardly extending hook element includes a plurality of ridges and is sized and shaped to carry a plurality of clothes hangers.

20. A track member for a storage system for articles and for mounting on a wall, the track member including:

a mounting portion sized and shaped to permit a fastener to pass there through and into a wall;

a L-shaped groove having a lower seating face and an upper retaining slot, a mid portion; and a lower alignment means comprising a groove, and a plurality of apertures formed in the groove at predetermined locations to facilitate the securing of said hanger brackets at spaced locations on said track member.

21. A track member for a storage system for articles and for mounting on a wall, the track member including:

a mounting portion sized and shaped to permit a fastener to pass there through and into a wall;

an L-shaped groove having a lower seating face and an upper retaining slot;

a mid portion; and an integral lower portion having a groove adapted for securely retaining a hanger bracket to said track member at said lower portion.

* * * * *